US010753606B2

(12) United States Patent
Huang et al.

(10) Patent No.: US 10,753,606 B2
(45) Date of Patent: Aug. 25, 2020

(54) GAS BURNER

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 168 days.

(21) Appl. No.: 16/039,819

(22) Filed: Jul. 19, 2018

(65) Prior Publication Data

US 2020/0025371 A1 Jan. 23, 2020

(51) Int. Cl.
*F23D 14/00* (2006.01)
*F23D 14/58* (2006.01)
*F23D 14/14* (2006.01)

(52) U.S. Cl.
CPC ..... *F23D 14/58* (2013.01); *F23D 14/145* (2013.01); *F23D 2203/102* (2013.01)

(58) Field of Classification Search
CPC ..... F23D 14/58; F23D 14/145
USPC ..... 431/354, 125, 353
See application file for complete search history.

(56) References Cited

U.S. PATENT DOCUMENTS 2,577,772 A * 12/1951 Kennedy ..... F23D 14/12 431/347
2,818,112 A * 12/1957 Wedlick ..... F23D 14/26 431/349
3,768,962 A * 10/1973 Baranowski, Jr. ..... F23D 14/64 431/353
4,846,143 A * 7/1989 Csadenyi ..... F23D 14/36 126/39 E
2002/0132198 A1* 9/2002 O'Donnell ..... F23D 14/105 431/125

* cited by examiner

*Primary Examiner* — Avinash A Savani
(74) *Attorney, Agent, or Firm* — R. Lynette Wylie; Apex Juris, Pllc.

(57) ABSTRACT

A gas burner includes a first tube and a second tube, wherein the first tube includes a first section and a second section which are connected to each other; the second section includes a chamber and an air outlet disposed at one side of the chamber; a cross-sectional area of the chamber of the second section is larger than a cross-sectional area of one end of the first section communicating with the second section. The second tube includes an air inlet section, a venturi section, and an extending section, wherein one end of the air inlet section includes an air inlet; the air inlet is adapted to supply gas; the venturi section is between the air inlet section and the extending section; the extending section extends into the chamber of the second section of the first tube and has a cross-sectional area small than the cross-sectional area of the chamber.

12 Claims, 9 Drawing Sheets

GAS BURNER

BACKGROUND OF THE INVENTION

Technical Field

The present invention is related to a gas burner, and more particularly to a low-pressure gas burner.

Description of Related Art

As shown in FIG. 1, a conventional burner 1 includes an air inlet 2 and an air outlet 3, wherein the air inlet 2 and the air outlet 3 are disposed at two opposite ends of the burner 1, respectively. An internal diameter of the burner 1 is gradually decreased and then gradually increased in a direction from the air inlet 2 to the air outlet 3 to form a chamber 4 which has a larger volume, before the air outlet 3. The air inlet 2 is adapted to supply gas and air; the air outlet 3 is adapted to output the gas mixed flow to generate flames after ignition.

Although the conventional burner 1 could burn gas to generate flames, however, the burner 1 is applied only to medium-pressure or high-pressure gas appliances (e.g. fast stove) and is not applied to low-pressure gas appliances, wherein the gas pressure unit is $mmH_2O$. A gas pressure between 230 and 330 $mmH_2O$ refers to low-pressure, and a gas pressure above 700 $mmH_2O$ refers to medium-pressure and high-pressure.

The conventional burner 1 is not applied to the low-pressure gas appliance because of the low gas pressure. As comparing to the medium-pressure or high-pressure gas appliance, the low-pressure gas appliance has a slower gas flow rate while the gas is flowing into the burner 1. In addition, the gas flow rate would become even slower when the gas passes through the chamber 4, because the burner 1 is gradually expanded in the direction from the air inlet 2 to the air outlet 3. In other words, when the gas is consumed by the flames in a speed faster than supplying the gas, the flames outside of the burner 1 would get into the interior of the burner 1 via the air outlet 3, resulting in an unsafe situation of backfire.

BRIEF SUMMARY OF THE INVENTION

In view of the above, an object of the present invention is to provide a gas burner which could be applied to low-pressure gas appliances.

To achieve the object mentioned above, the present invention provides a gas burner including a first tube and a second tube, wherein the first tube includes a chamber and an air outlet disposed at one side of the chamber; the second tube is connected to the first tube and includes an air inlet section, a venturi section, and an extending section, wherein one end of the air inlet section includes an air inlet, and the air inlet is adapted to supply gas to the second tube; the venturi section is between the air inlet section and the extending section, and includes a passage with a throat portion; the extending section extends into the chamber of the first tube and has a cross-sectional area small than a cross-sectional area of the chamber.

The advantage of the present invention is that through extending the extending section into the chamber, the gas flow rate between the extending section of the second tube and the chamber would not become slow while utilizing the low-pressure gas appliances and the situation of backfire could also be avoided after the gas is ignited. In addition, with the larger cross-sectional area of the chamber, flames could be generated in a broader area outside of the air outlet.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
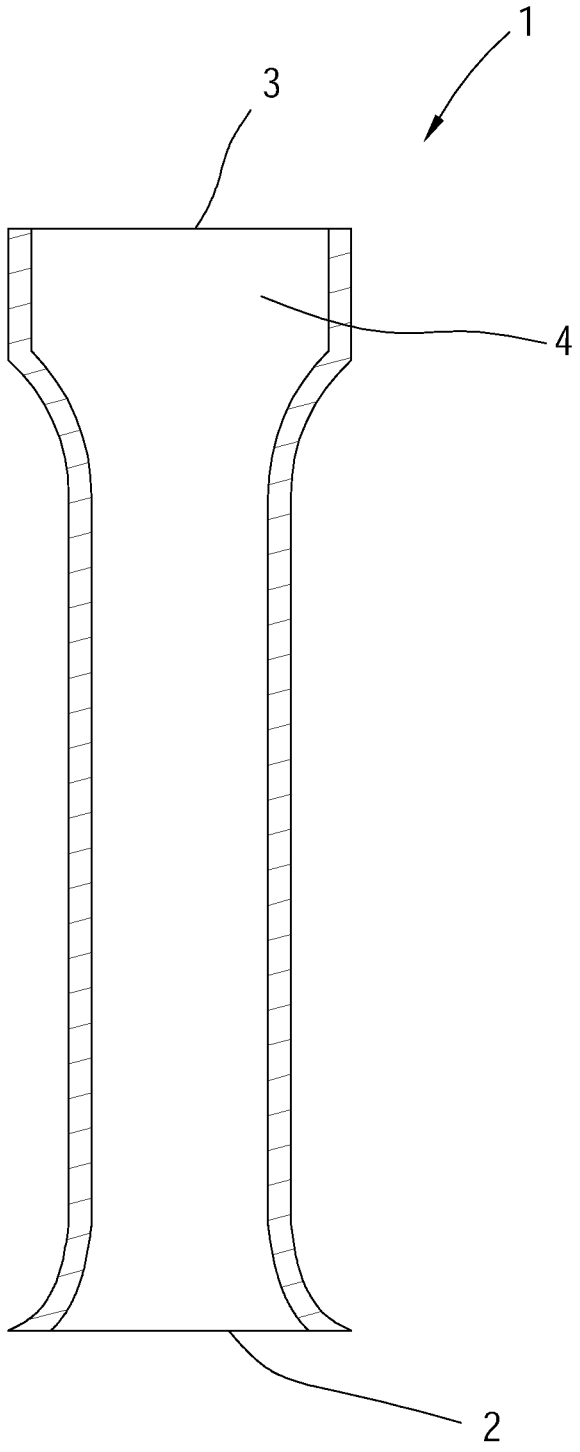
FIG. 1 (PRIOR ART)
FIG. 1 is a cross-sectional view of a conventional burner.
Figure 2:
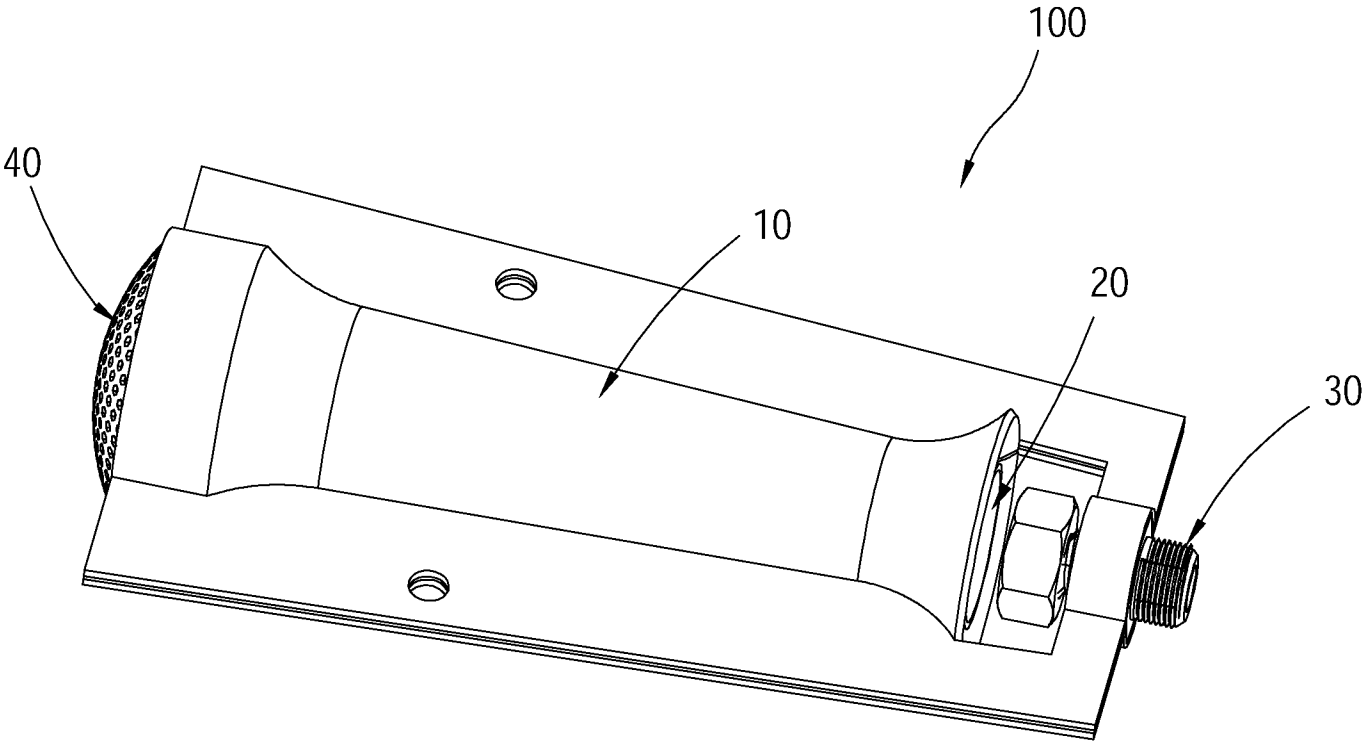
FIG. 2 is a perspective view of a gas burner of a first embodiment according to the present invention.

The following illustrative embodiments and drawings are provided to illustrate the disclosure of the present invention, these and other advantages and effects can be clearly understood by persons skilled in the art after reading the disclosure of this specification. Referring to FIG. 2, a gas burner 100 of a first embodiment according to the present invention includes a first tube 10, a second tube 20, a nozzle 30, and a fire grid 40, wherein the first tube 10 is an outer tube as an example, and the second tube 20 is an inner tube as an example.

Figure 3:
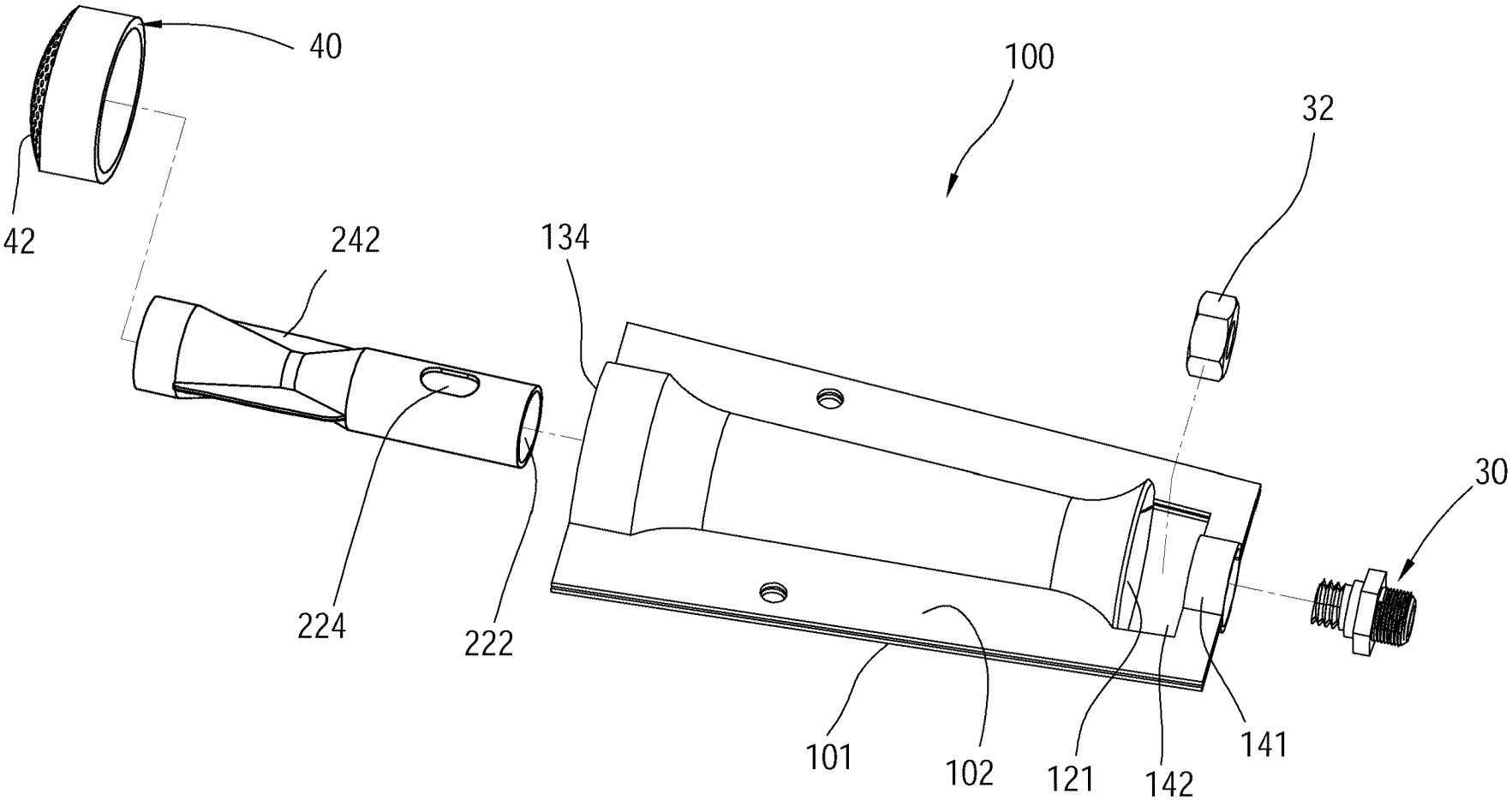
FIG. 3 is an exploded view of the gas burner of FIG. 2.
Figure 4:
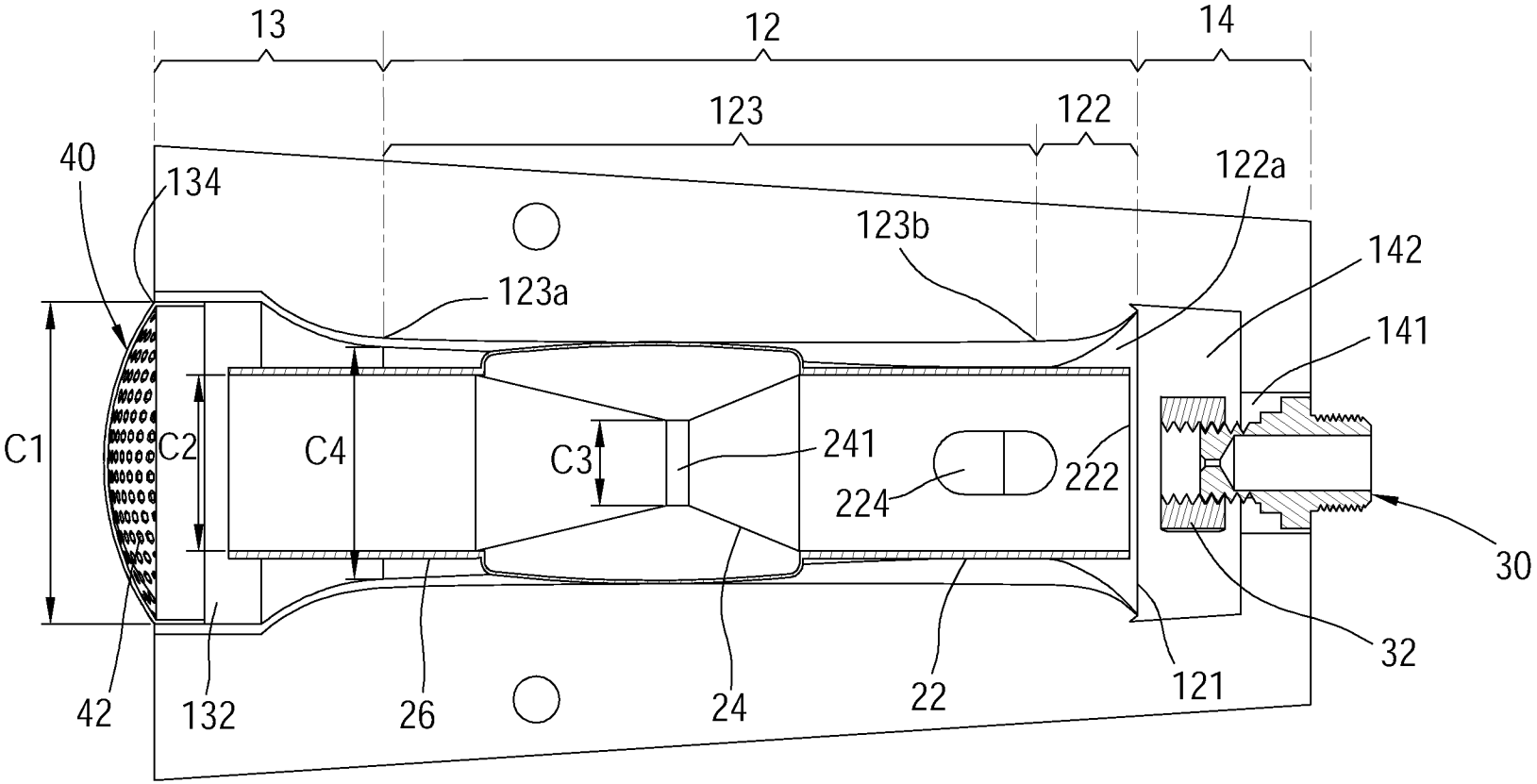
FIG. 4 is a cross-sectional view of the gas burner of FIG. 2.
Figure 5:
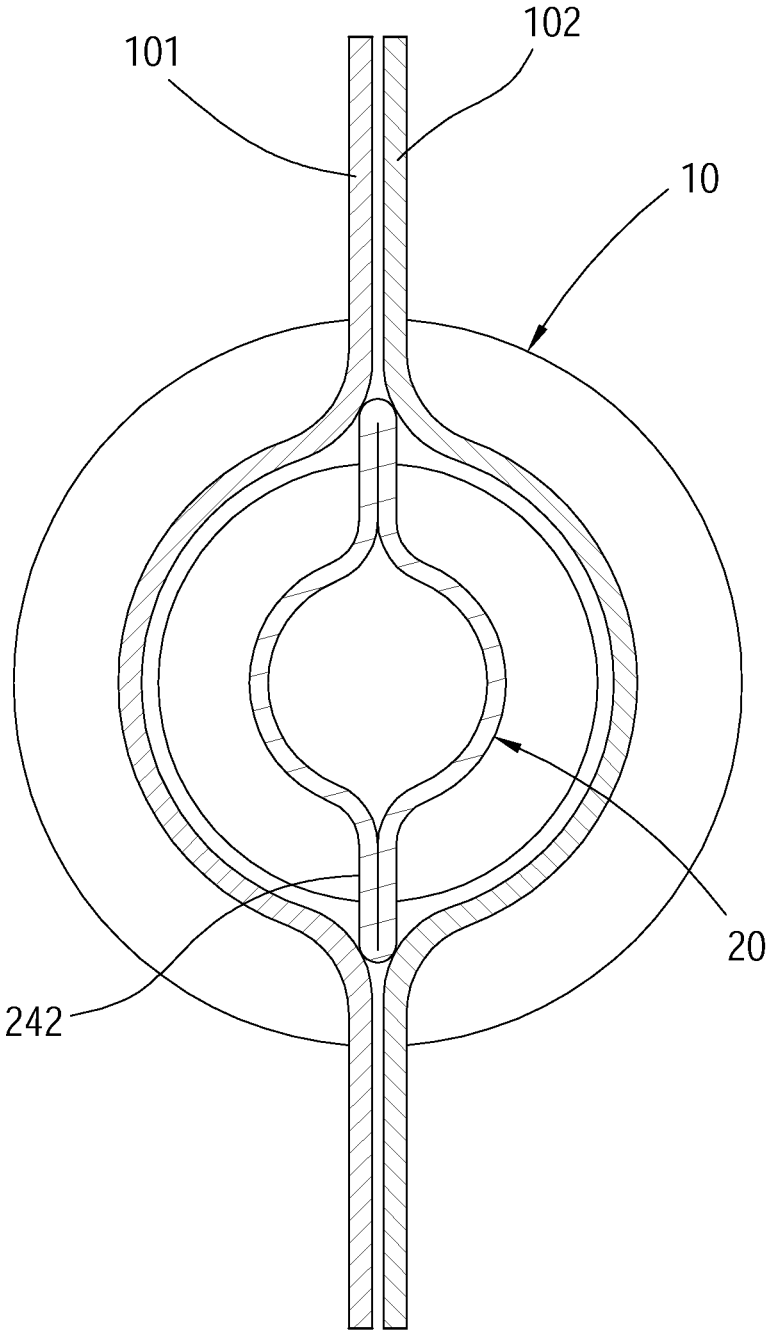
FIG. 5 is a cross-sectional view of the gas burner of FIG. 2.

Referring to FIG. 3 to FIG. 5, the first tube 10 includes a first section 12 and a second section 13, wherein one end of the first section 12 has an open end 121, and another end of the first section 12 communicates with the second section 13. The second section 13 includes a chamber 132 and an air outlet 134, wherein the chamber 132 is formed by the first section 12 of the first tube 10 which expands in a direction toward the second section 13, and the air outlet 134 is disposed at one side of the chamber 132 away from the first section 12.

The second tube 20 includes an air inlet section 22, a venturi section 24, and an extending section 26, wherein the air inlet section 22 is disposed within the first section 12 of the first tube 10, and includes an air inlet 222 at one end close to the open end 121. The air inlet 222 is adapted to supply gas to the second tube 20. The venturi section 24 is between the air inlet section 22 and the extending section 26, and includes a passage with a throat portion 241, wherein the throat portion 241 is adapted to speed up the gas flow rate in the passage. The extending section 26 extends into the chamber 132 of the second section 13 of the first tube 10. A cross-sectional area C2 of the extending section 26 is small than a cross-sectional area C1 of the chamber 132.

Referring to FIG. 4, in this embodiment, the cross-sectional area C1 of the chamber 132 is 3 to 3.5 times of the cross-sectional area C2 of the extending section 26; the cross-sectional area C2 of the extending section 26 is 4 to 4.5 times of a cross-sectional area C3 of the throat portion 241; a cross-sectional area C4 of another end 123*a* of the first section 12 is 1.5 to 1.7 times of the cross-sectional area C2 of the extending section 26.

The nozzle 30 is engaged with the first tube 10 and is adapted to be connected to a gas source such that the gas could flow into the second tube 20 via the air inlet 222. More specifically, the first tube 10 is constituted by two plates 101, 102 which are jointed to each other and both have a predetermined shape. The first tube 10 includes an extending portion 14 disposed outside of the open end 121. The extending portion 14 includes a loop 141, wherein the loop 141 is disposed correspondingly to the open end 121 and is adapted to fix the nozzle 30. In this embodiment, the extending portion 14 further includes a slot 142 disposed between the open end 121 and the loop 141, and the nozzle 30 is engaged with a nut 32 which is disposed in the slot 142.

The fire grid 40 includes a plurality of meshes 42 and is disposed at the air outlet 134 of the first tube 10. The fire grid 40 protrudes outwardly in a direction away from the second section 13 such that the mixed gas ejected from the fire grid 40 could be spread in a broader area. The meshes 42 of the fire grid 40 are adapted to uniformly distribute the ejected gas flow. When the gas burner 100 is ignited, the flames could burn evenly because the gas flow is ejected uniformly.

In this embodiment, the first section 12 of the first tube 10 includes a first subsection 122 and a second subsection 123 which are connected to each other, wherein the first subsection 122 is connected to one end 123*b* of the second subsection 123. One end of the first subsection 122, which is not connected to the end 123*b*, is the open end 121, and one end 123*a* of the second subsection 123, which is not connected to the first subsection 122, communicates with the second section 13. It is worth mentioning that a shrinking passage 122*a* is formed in an interior of the first subsection 122 in a direction from the open end 121 to the second subsection 123; the venturi section 24 of the second tube 20 includes a pair of wing sections 242 disposed outside of the throat portion 241. The second tube 20 is detachably disposed within the first tube 10. Whereby, the second tube 20 could be engaged with an inner wall of the first section 12 of the first tube 10 effectively via the shrinking passage 122*a* and the pair of wing sections 242, and the engaging space could be effectively reduced. (as shown in FIG. 4).

Moreover, the second tube 20 is inserted into the first tube 10 from the air outlet 134 of the first tube 10, and the air inlet section 22 of the second tube 20 is provided with two perforations 224 on a wall thereof, wherein the two perforations 224 are disposed corresponding to each other and communicate with the shrinking passage 122*a* of the first tube 10 to introduce the air into the second tube 20. In other embodiments, before the two plates 101, 102 are jointed to each other, the second tube 20 could also be disposed between the two plates 101, 102 and then the two plates 101, 102 are jointed to each other to make the second tube 20 engage with the first tube 10. Alternatively, the second tube 20 and the first tube 10 could be directly connected to each other as well. The wall of the air inlet section 22 could be disposed without the perforations 224 or disposed with more than three perforations 224 to introduce the air.

Figure 6:
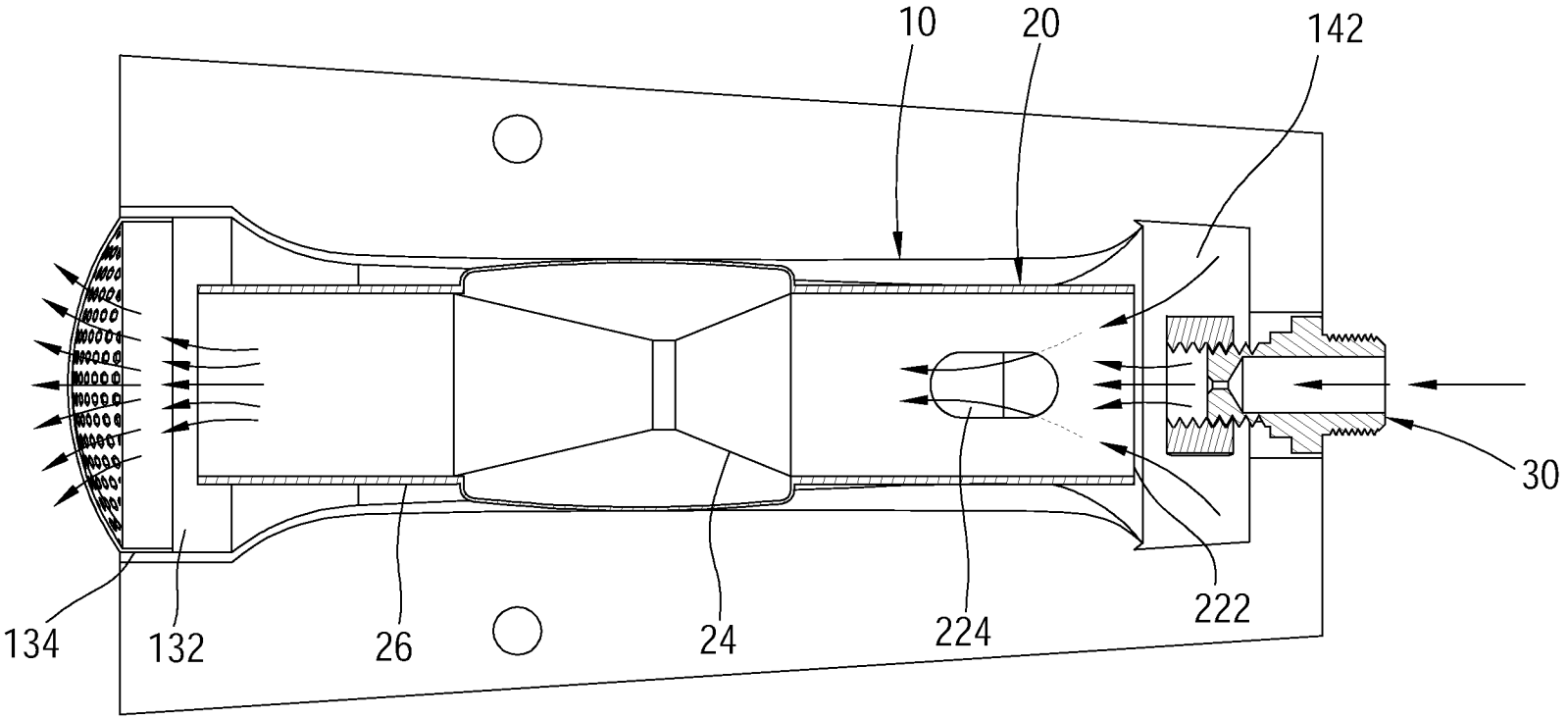
FIG. 6 is a schematic view showing how the gas flow passes through the gas burner.

Referring to FIG. 6, after being ejected from the nozzle 30, the gas flow passes through the slot 142 and flows into the second tube 20 via the air inlet 222 of the second tube 20. Meanwhile, the air is also introduced into the second tube 20 via the slot 142 to form a gas mixed flow. When the gas mixed flow in the second tube 20 passes through the perforations 224, the air in the first tube 10 would be introduced into the second tube 20 via the perforations 224. The gas flow rate would speed up due to the reducing passage while the gas mixed flow passes through the venturi section 24; after being outputted from the extending section 26 to the chamber 132 of the first tube 10, the gas mixed flow would be ejected out of the first tube 10 via the air outlet 134. It is worth mentioning that the cross-sectional area C2 of the extending section 26 is smaller than the cross-sectional area C1 of the chamber 132. Whereby, the gas flow rate would not become slow due to the expanding passage from the first section 12 to the second section 13 and the reducing pressure in the tube, such that a backfire caused by a combustion speed being faster than the gas flow rate in the passage could be avoided.

It is worth mentioning that according to the gas burner 100 of the present invention, a mixed ratio of the gas and the air would not reach to a combustion ratio until the gas passes through the fire grid 40 and be mixed with the air outside of the fire grid 40 after. That is, the flames would be generated outside of the fire grid 40 rather than inside of the gas burner 100 so as to avoid a danger of backfire. In addition, with the larger cross-sectional area C1 of the chamber 132, the flames could be generated in a broader area outside of the air outlet 134.

Figure 7:
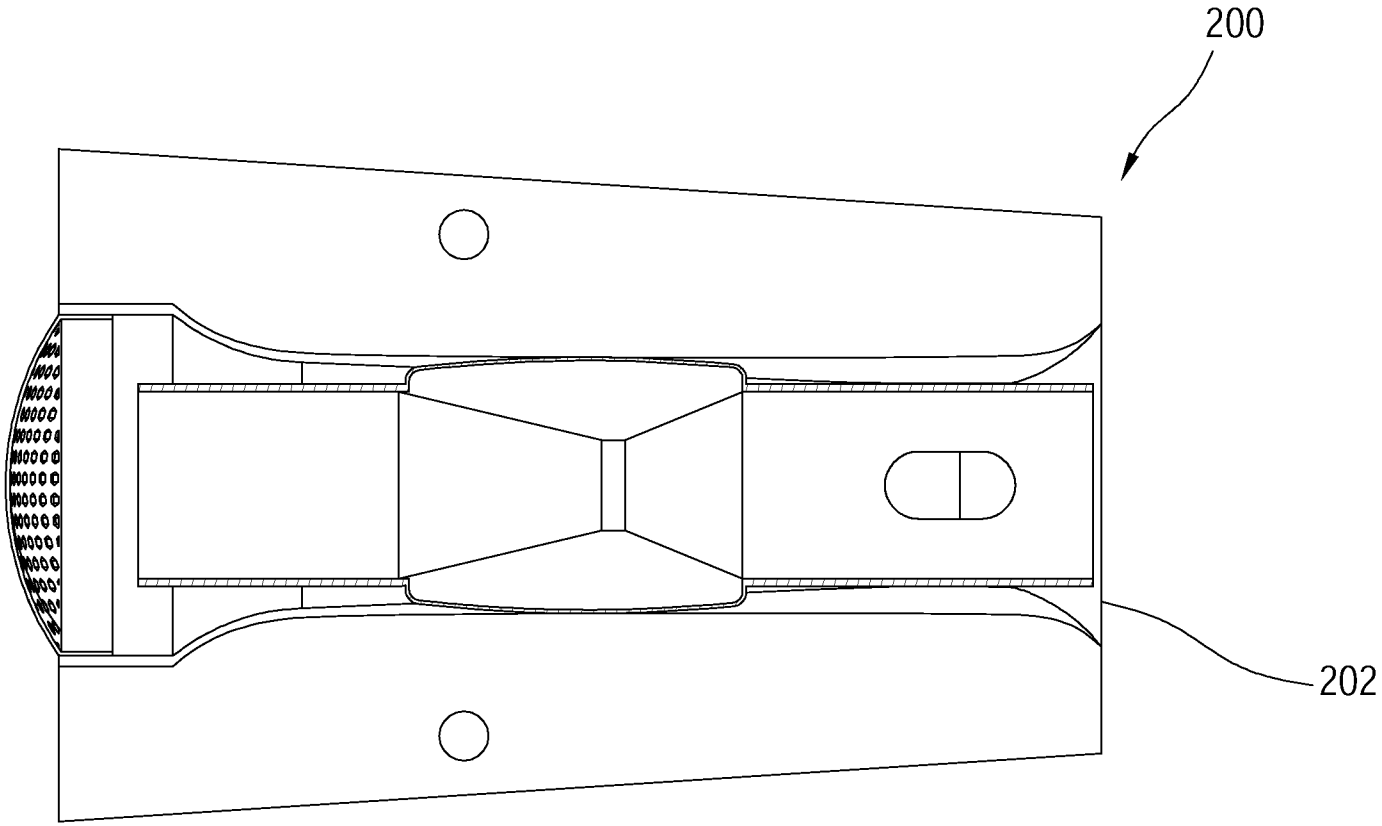
FIG. 7 is a cross-sectional view of a gas burner of a second embodiment according to the present invention.

Referring to FIG. 7, a gas burner 200 of a second embodiment according to the present invention is different from the gas burner 100 of the first embodiment. The gas burner 200 does not include the nozzle 30 and the extending portion 14 of the first embodiment. The gas would directly flow into the gas burner 200 via an open end 202.

Figure 8:
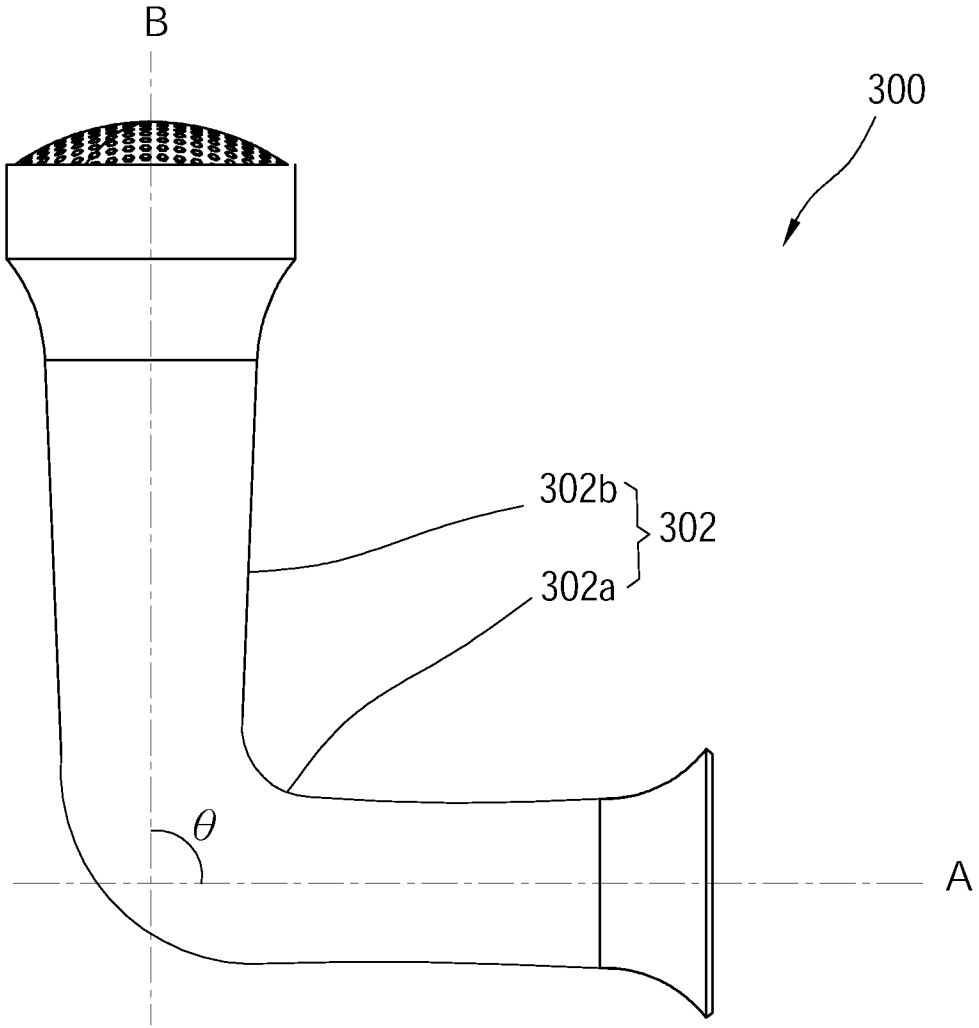
FIG. 8 is a perspective view of a gas burner of a third embodiment according to the present invention.

Referring to FIG. 8, a gas burner 300 of a third embodiment according to the present invention is different from the gas burner 100 of the first embodiment. The gas burner 300 has a bent shape. A first tube 302 of the gas burner 300 includes a first section 302*a* and a second section 302*b*, wherein the first section 302*a* and the second section 302*b* extend along a first axis A and a second axis B, respectively. The first axis A and the second axis B form an angle θ. In this embodiment, the angle θ ranges from 85 to 105 degrees. The angle θ could alter to be engaged with a variety of gas appliances depending on the requirements. An air inlet section and a venturi section of a second tube (not shown) are disposed in the first section 302*a*, and an extending section is disposed in the second section 302*b*.

Figure 9:
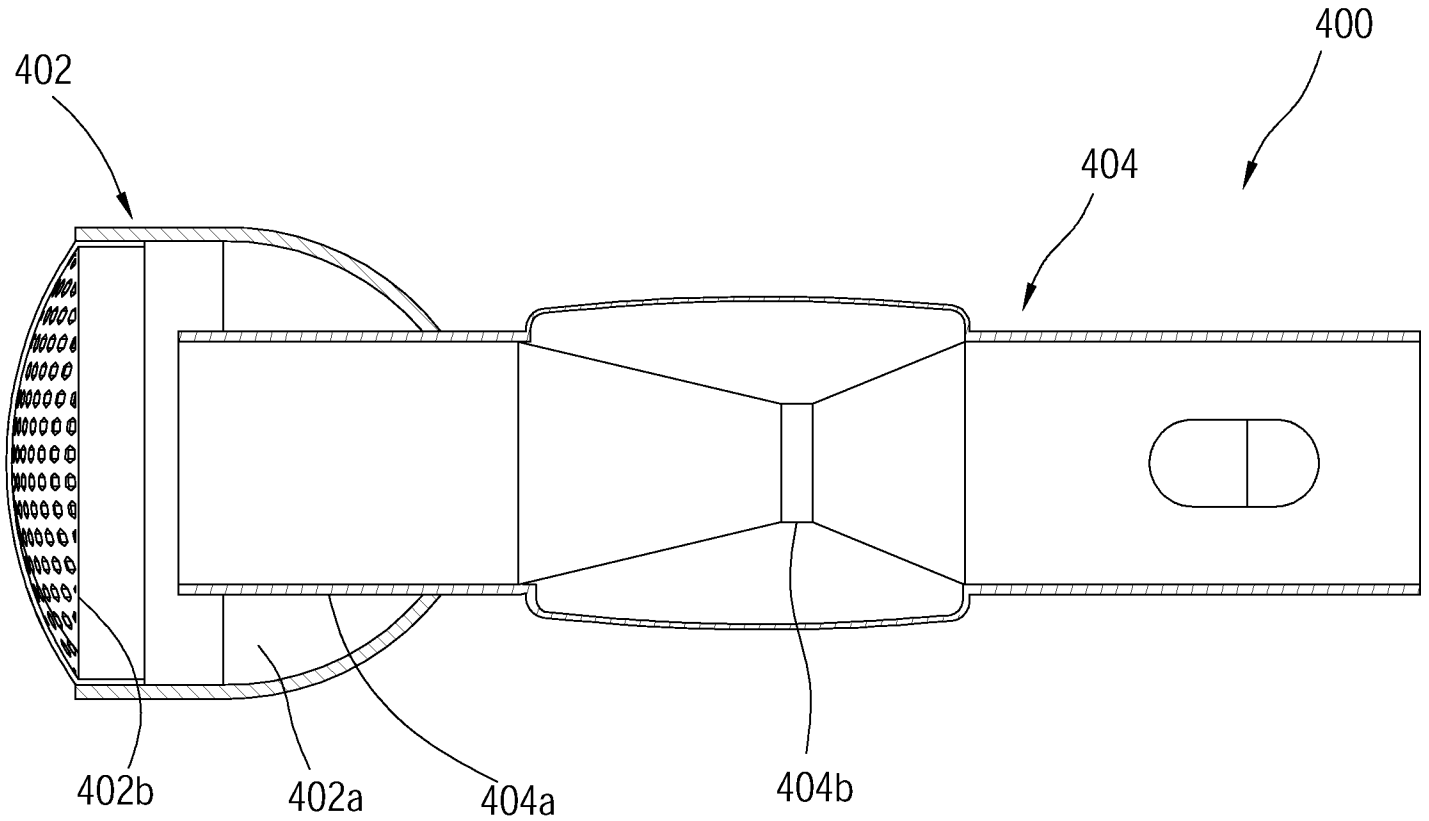
FIG. 9 is a perspective view of a gas burner of a fourth embodiment according to the present invention.

Referring to FIG. 9, a gas burner 400 of a fourth embodiment according to the present invention is different from the gas burner 100 of the first embodiment. A first tube 402 of the gas burner 400 includes only a chamber 402*a* and an air outlet 402*b*, and an extending section 404*a* of a second tube 404 extends into the chamber 402*a*. The first tube 402 is engaged with the second tube 404. In this embodiment, the first tube 402 is engaged with the extending section 404*a* of the second tube 404 and could be engaged with a venturi section 404*b* of the second tube 404 as well. The volume of the gas burner 400 could be reduced by shortening the length of the first tube 402.

According to the illustration mentioned above, with the aforementioned configurations of the gas burner of the present invention, when a low-pressure gas appliance is utilized, a situation that backfire is generated due to a combustion speed outside of the fire grid being faster than the gas supplying speed because of insufficient gas flow rate in the tube of the gas burner could be avoided. Whereby, the gas burner of the present invention could be applied to the low-pressure gas appliance with gas pressure ranging from 230 to 330 $mmH_2O$ and the flames could be generated in a broader area with the larger cross-sectional area of the chamber.

It must be pointed out that the embodiments described above are only some embodiments of the present invention. All equivalent structures which employ the concepts disclosed in this specification and the appended claims should fall within the scope of the present invention.

What is claimed is:

1. A gas burner, comprising:

a first tube, including a chamber and an air outlet disposed at one side of the chamber; and a second tube, being connected to the first tube, and including an air inlet section, a venturi section, and an extending section, wherein one end of the air inlet section includes an air inlet;

the air inlet is adapted to supply gas to the second tube; the venturi section is between the air inlet section and the extending section, and includes a passage with a throat portion; the extending section extends into the chamber of the first tube, and a cross-sectional area of the extending section is small than a cross-sectional area of the chamber;

wherein the second tube is disposed within the first tube, a section of the passage between the throat portion and the air inlet section has a width gradually decreasing in a direction toward the throat portion, a section of the passage between the throat portion and the extending section has a width gradually decreasing in a direction toward the throat portion.

2. The gas burner of claim 1, wherein the first tube further includes a first section and a second section, wherein one end of the first section has an open end, and another end of the first section communicates with the second section; the second section includes the chamber and the air outlet.

3. The gas burner of claim 2, wherein the second tube is detachably disposed within the first tube.

4. The gas burner of claim 3, wherein the venturi section of the second tube is engaged with an inner wall of the first section of the first tube.

5. The gas burner of claim 4, wherein the venturi section of the second tube further includes a pair of wing sections disposed outside of the throat portion; the pair of wing sections are engaged with the inner wall of the first section of the first tube.

6. The gas burner of claim 4, wherein the first section of the first tube further includes a first subsection and a second subsection which are connected to each other, wherein the first subsection has the open end, and the second subsection communicates with the second section; a shrinking passage is formed in an interior of the first subsection in a direction from the open end to the second subsection; the air inlet section of the second tube is provided with at least one perforation on a wall thereof, wherein the at least one perforation communicates with the shrinking passage.

7. The gas burner of claim 2, wherein the first tube is constituted by two plates which are jointed to each other and both have a predetermined shape.

8. The gas burner of claim 7, further comprising a nozzle, which is adapted to be connected to a gas source; wherein, the first tube includes an extending portion disposed outside of the open end, and the extending portion includes a loop disposed correspondingly to the open end; the nozzle is disposed on the loop.

9. The gas burner of claim 8, wherein the first tube further includes a slot disposed between the open end and the loop.

10. The gas burner of claim 1, further comprising a fire grid, which includes a plurality of meshes; the fire grid is disposed at the air outlet of the first tube.

11. The gas burner of claim 10, wherein the fire grid protrudes outwardly in a direction away from the second section.

12. The gas burner of claim 2, wherein the cross-sectional area of the extending section is smaller than a cross-sectional area of another end of the first section.

* * * * *